US009895599B2

(12) United States Patent
Martino

(10) Patent No.: US 9,895,599 B2
(45) **Date of Patent: *Feb. 20, 2018**

(54) DELIVERY SHOE WITH MASKING CAPABILITY FOR CARD BACKS

(71) Applicant: Brittney Rose Martino, Las Vegas, NV (US)

(72) Inventor: Brittney Rose Martino, Las Vegas, NV (US)

( * ) Notice: Subject to any disclaimer, the term of this patent is extended or adjusted under 35 U.S.C. 154(b) by 94 days.

This patent is subject to a terminal disclaimer.

(21) Appl. No.: 14/977,933

(22) Filed: Dec. 22, 2015

(65) Prior Publication Data

US 2017/0173447 A1 Jun. 22, 2017

(51) Int. Cl.

| | |
|---|---|
| ***A63F 1/12*** | (2006.01) |
| ***A63F 1/10*** | (2006.01) |
| *F21V 33/00* | (2006.01) |
| *F21Y 115/10* | (2016.01) |

(52) U.S. Cl.

CPC ..... *A63F 1/10* (2013.01); *A63F 2250/58* (2013.01); *F21V 33/008* (2013.01); *F21Y 2115/10* (2016.08)

(58) Field of Classification Search

CPC ..... A63F 1/12
USPC ..... 273/149 R
See application file for complete search history.

(56) References Cited

U.S. PATENT DOCUMENTS

| | | | | |
|---|---|---|---|---|
| 6,403,908 | B2 * | 6/2002 | Stardust | A63F 1/14 209/547 |
| 6,629,894 | B1 * | 10/2003 | Purton | A63F 1/06 273/149 R |
| 7,593,544 | B2 * | 9/2009 | Downs, III | A63F 1/14 273/148 A |
| 7,933,444 | B2 * | 4/2011 | Downs, III | A63F 1/14 273/148 A |
| 7,967,672 | B2 * | 6/2011 | Shigeta | A63F 1/18 235/468 |
| 8,070,574 | B2 * | 12/2011 | Grauzer | A63F 1/12 273/149 R |
| 8,170,323 | B2 * | 5/2012 | Downs, III | A63F 1/14 273/148 A |
| 8,221,244 | B2 * | 7/2012 | French | G07F 17/32 463/11 |
| 8,727,350 | B2 * | 5/2014 | Flynn | A63F 1/14 273/149 R |

(Continued)

*Primary Examiner* — John E Simms, Jr.

*Assistant Examiner* — Dolores Collins

(74) *Attorney, Agent, or Firm* — Mark A. Litman & Associates, P.A.

(57) ABSTRACT

A method of using a dealer shoe that is configured to provide access to and removal of playing cards from within the dealer shoe includes:

a base, a front plate forming a lower gap with the plate through which individual playing cards can pass, a top, and opposed sides joining the base, top, two sides and the front plate to form a card-carrying cavity. The front plate further is associated with a light producing element configured to shine light (e.g., in patterns, in colors, and the like) over a back of a first playing card extending out of the lower gap; and the wavelength and intensity and qualities of the shone light being sufficient to reduce optical contrast of different colors and/or shades on the back of the first playing card or otherwise disrupt optical viewing of printed images on the backs of playing cards.

22 Claims, 4 Drawing Sheets

(56) References Cited

U.S. PATENT DOCUMENTS

| | | | | |
|---|---|---|---|---|
| 8,777,710 | B2 * | 7/2014 | Grauzer | A63F 1/12 273/149 R |
| 8,969,802 | B1 * | 3/2015 | Blazevic | A63F 1/12 250/330 |
| 9,539,495 | B2 * | 1/2017 | Scheper | A63F 1/14 |
| 2009/0054161 | A1 * | 2/2009 | Schubert | A63F 1/14 463/47 |
| 2010/0038849 | A1 * | 2/2010 | Scheper | A63F 1/14 273/149 R |
| 2011/0198805 | A1 * | 8/2011 | Downs, III | A63F 1/14 273/149 R |
| 2014/0042697 | A1 * | 2/2014 | Berube | A63F 1/14 273/149 R |
| 2014/0347471 | A1 * | 11/2014 | Blazevic | G01N 21/8806 348/128 |
| 2015/0265909 | A1 * | 9/2015 | Schubert | A63F 1/14 273/149 R |

* cited by examiner

DELIVERY SHOE WITH MASKING CAPABILITY FOR CARD BACKS

BACKGROUND OF THE INVENTION

1. Field of the Invention

The present invention relates to the field of playing card delivery systems, and particularly dealing shoes that mask all card backs, and only after manually driven delivery of playing cards is any back surface of a playing card disclosed without masking of the card back.

2. Background of the Art

Playing cards are used in many social and entertainment games, and are most often used in casinos in casino table wagering games. It is important to the fairness of the games that pre-knowledge of the cards is not available to players. Numerous illegal efforts are made to give individuals or players an unfair advantage by marking or daubing playing cards with marks on backs or edges of playing cards that indicate the rank and/or suit of cards. Most of these techniques are overcome by careful inspection of playing cards, even by mechanical/electromagnetic imaging means, as in U.S. Pat. No. 8,969,802 and Published US Patent Application Publication No. 20140347471 (Blazevic).

It has been known for some time that when playing cards are cut from sheet with patterned backs, the cuts were unevenly placed on the patterns, and the relative position on the cuts could be read over time as indicative of the position of the card on the original sheet, which in turn was indicative of the rank and/or suit of the card's face.

To overcome this issue, a white border was expanded around the sections on the back pattern relatively corresponding to the expected position of the card values on the front side of the card faces. Because printing alignment is not perfect, distances from edges across the white borders also varies sufficiently as to offer similar pre-knowledge of rank and suit values from the backs of playing cards as the edges extend out of the dealer's shoe.

It has become desirable to find a better way of preventing early viewing of the backs of playing cards as they are dealt that might enable preview of card ranks.

Published US Patent Application Nos. 20150265909 and 20090054161 (Schubert) and U.S. Pat. Nos. 8,777,710 and 8,070,574 (Grauzer) discloses a playing card delivery shoe used in the play of the casino table card game of blackjack. The shoe may include an area for receiving a first set of playing cards, a first card mover that moves playing cards from the first set of playing cards to a playing card staging area, a second playing card mover that moves playing cards from the playing card staging area to a delivery area, and playing card-reading sensors that read at least one playing card value of each playing card separately after each playing card has been removed from the area for receiving the first set of playing cards and before removal from the playing card delivery area. A processor analyzes the data and displays certain game-related data on a display device. Methods of providing cards to a dealer in a casino table card game of blackjack are disclosed.

Published US Patent Application No. 20140327208 (Grauzer) discloses card-handling devices including a card-holding area and a card output shoe. The card output shoe includes a card-way for passage of cards from the card-holding area into a dealing-ready area. A movable gate is positioned between the card-way and the dealing-ready area to prevent cards in the dealing-ready area from re-entering the card-way. Card shufflers include a gate mounted to allow movement of randomized groups of cards from card-receiving compartments to proximate a terminal end plate of a card output shoe and to block movement of cards in an opposite direction. In related methods of moving cards, card movement through the card-way to the dealing-ready position is allowed by a movable gate and card movement from the dealing-ready position into the card-way is prevented by the movable gate.

Published US Patent Application No. 20120091656 (Blaha) discloses card handling systems including shuffling devices, shoe devices, and a card transfer system for automatically transferring cards from the shuffling device into the shoe device. Shuffling devices may include a divider configured to contact at least one card positioned within a compartment of the shuffling device. Shoe devices may include a card loading system for loading cards into a card storage area through an opening in a base of the shoe device. Methods of providing cards during a casino table game play include identifying card information including a rank and a suit of each card in a shuffling device and a shoe device and transporting cards from the shuffling device to the shoe device.

Published US Patent Application No. 20110198805 (Downs III) discloses a playing card delivery shoe that is used in the play of the casino table card game of baccarat or blackjack or any game where cards are pulled one at a time from the shoe. The apparatus comprises a reader or an imager that scans lines bisecting the image at spaced intervals. The scanning occurs on playing cards in at least the region where suit and rank symbols are provided. The scanner output is a series of voltages that are converted to binary information. This binary information is compared to stored binary information to determine rank and suit. The upper surface of the output end of the shoe contains a partial barrier for cards being scanned. The partial barrier has an elevated surface and limits a size of a pathway so that only one card can be removed at a time.

U.S. Pat. No. 4,750,743 (Nicoletti) describes the use of a mechanical card dispensing means to advance cards at least part way out of the shoe. The described invention is for a dispenser for playing cards comprising: a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot; card advancing means contacting the trailing card and adapted to urge the stacked cards down the inclined floor; card dispensing means positioned proximate the front wall and adapted to dispense a single card at a time.

Published US Patent Application No. 20100213668 (Dickinson) discloses an automatic card shuffler includes a card input unit, card ejection unit, card separation and delivery unit and card collection unit. A card ejection unit ejects cards in a singular fashion from a stack of cards placed into the input unit. The ejected cards are passed through a dynamic de-doubler that prevents more than a pre-established number of cards from passing through. The dynamic de-doubler is able to shift positions to accommodate card that are bent, impacted by environmental conditions and otherwise worn. The cards are ejected to a stop arm maintaining the entrance to the card separation unit. Upon processor command, the stop arm raises to allow a plurality of cards to pass under to the card separation and delivery unit. A series of rotating belts and rollers act to separate the cards and propel them individually to the collection unit. A floating gate slightly forward of the stop arm dictates that a minimum number of cards are managed simultaneously. The shuffler is controlled by a processing unit in communication with multiple internal sensors.

Published US Patent Application Nos. 20200213667 and 20050012269 (Grauzer) discloses a distinct dealing shoe having no shuffling functionality receives shuffled, randomized or ordered group of cards. The cards may be mechanically moved one at a time from a receiving area for the deck to a buffer area where more than one card is temporarily stored. The cards in the buffer area are then mechanically moved to a card delivery area where the cards may be manually removed, one-at-a-time, by a dealer. The cards are read one-at-a-time inside of the dealing shoe, either before the buffer area or after leaving the buffer area, but preferably before the cards are being manually removed from the card delivery area. The information from the card reading may be used for game tracking, hand tracking, player information, and other security issues at casino table card games.

U.S. Pat. No. 4,659,082 (Greenberg) discloses a Monte Verde card dispenser of shoe that simulates a card shoe containing a playing card deck or near infinite length. The card dispenser includes a rotary carousel containing a plurality of card carrying compartments around the periphery thereof. The cards area injected with the carousel from the input hopper and ejected from the carousel into an output hopper for use by the dealer.

U.S. Pat. No. 6,402,142 (Warren) discloses an apparatus for dealing cards at a casino gaming table. The apparatus, or dealer shoe, has a base and a card roller.

The base holds a deck or decks of cards while in use. The card roller is movably connected to the base and applies a downward pressure on the cards in the base so that they may be removed from the base. The card roller is moved into a resting place within the base when cards are removed to be shuffled, facilitating removal and insertion of the cards. By resting in the base, the card roller is protected from damage.

These technologies are not considered the best or most cost-effective solutions to the present issues, but are all incorporated herein in their entirety by reference.

SUMMARY OF THE INVENTION

A method of using a dealer shoe that is configured to provide access to and removal of playing cards from within the dealer shoe includes:

a base, a front plate forming a lower gap with the plate through which individual playing cards can pass, a top, and opposed sides joining the base, top, two sides and the front plate to form a card-carrying cavity. The front plate further has a light producing element configured to shine light over a back of a first playing card extending out of the lower gap; and the wavelength and intensity of the shone light being sufficient to reduce optical contrast of different colors and/or shades on the back of the first playing card.

DETAILED DESCRIPTION OF THE INVENTION

Figure 1A:
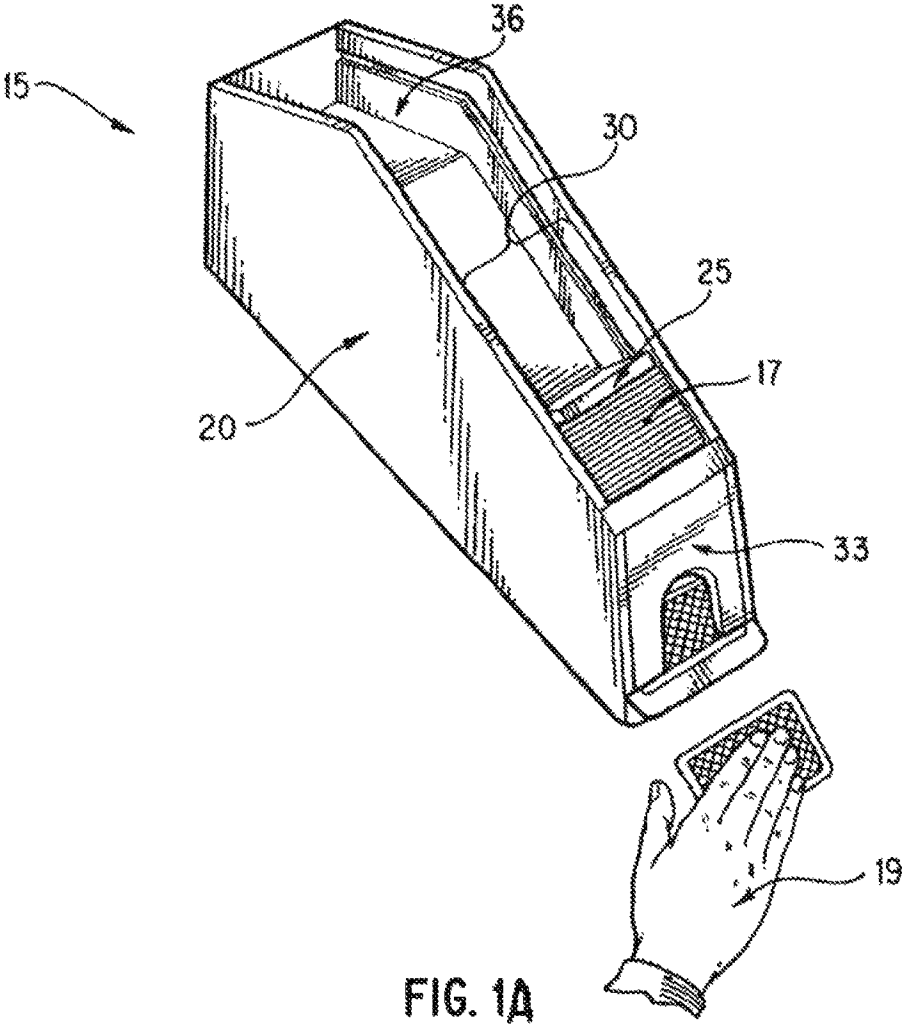
FIG. 1A shows a delivery shoe according to the present technology in which light is emitted from above the leading edge of a first forward playing card in the delivery shoe.

A method for providing access to and removal of playing cards in a dealer shoe, may include the steps of:

placing one or more decks of cards (e.g., playing cards having suit and rank on a face and an image or pattern with or without white edging on their backs) in a dealer shoe comprised of a base, front plate forming a lower gap with the plate through which individual playing cards can pass, a top, and opposed sides joining the base, top, two sides and the front plate. The front plate further has a light producing element (e.g., LED panels or bulbs, fluorescent bulbs, incandescent bulbs, semiconductor light emitters and the like) configured to shine visible light over a back of a first playing card extending out of the lower gap. The purpose of the light(s) is to overlay colors or tones and white background on the back of the playing card.

The wavelength, pattern (e.g., discontinuous distribution of light) and intensity of the shone light being sufficient to reduce optical contrast of different colors and/or shades on the back of the first playing card. The pattern can disrupt visible perception of the actual pattern printed on the back of the playing card. The emitted/projected pattern may be significantly different from the printed pattern, or only slightly vary from the printed pattern to confuse optical/visible reading of the printed image. Where the back of the card, for example, has red-and-white colors, the emitted light should be sufficiently red to color and blend the white into the red; when the back of the card is greenish, the emitted light should sufficiently match the green, and similarly with single colors or multiple colors on the backs of the cards and the emitters. The method and dealer shoe may be practiced wherein the shone light is emitted from the top of the shoe over the back of the first playing card extending out of the lower gap, wherein the shone light is emitted from the base of the shoe and upwardly over the back of the first playing card extending out of the lower gap, or both from above and below the leading edge and top of the back of the playing card. The method may be practiced wherein the shone light is within ±100, ±70 nm Or ±50 nm of at least one color on the back of the first playing card. The method may be practiced wherein at least two lights are shone over the back of the first playing card extending out of the lower gap, and the at least two distinct light colors/emissions differ by at least ±50 nm from each other.

The method may be practiced wherein the shone light is emitted with a visual distraction factor selected from the group consisting of fluttering light intensity, angular light movement across the back of the first playing card extending out of the lower gap, and variation in light wavelengths. The method may further include placing a set of randomized playing cards in the dealer shoe so that one surface of a forward most playing card faces the shone light.

A dealer shoe is configured to provide access to and removal of playing cards from within the dealer shoe which has:

a base, a front plate forming a lower gap with the plate through which individual playing cards can pass, a top, and opposed sides joining the base, top, two sides and the front plate to form a card-carrying cavity, the front plate further comprising a light producing element configured to shine light over a back of a first playing card extending out of the lower gap; and the wavelength and intensity of the shone light being sufficient to reduce optical contrast of different colors and/or shades on the back of the first playing card.

The ability to know or even approximate the value of an unrevealed card in a casino table game can give the player a significant mathematical advantage. There are a number of ways this is done: such as marking the cards with a faint ink, or an ink revealed using special glasses or nicking, bending, tearing specific card values. One recent technique, commonly referred to as edge sorting, does not involve altering the cards in any way. The player observes imperfections in the manufacture of the card, specifically related to variations in size between the printed pattern on the back of the card and the white edge that surrounds it. An observant player can observe differences in thickness of less than a millimeter and use that knowledge to identify the value of the hidden card. This knowledge could affect the size of the player's initial bet in blackjack or baccarat as well as any decisions the player may make (such as choosing to hit or stay in blackjack). The present technology can assist in overcoming those deficiencies.

The design of current casino card shoes reveal the bottom edge of the card. This is necessary as the dealer must have a reasonable space available to their fingers in order to slide the next card in the shoe out with his finger. In order to protect from this form of advantage play, it is to the casino's advantage to obscure the player's ability to look at the exposed edge of the card. However, any cover or mechanical device that would physically block the player's ability to see the exposed edge would also impede the dealer's ability to efficiently remove each card from the shoe thus slowing down the speed each game is dealt.

Rather than using a physical barrier or cover to hide any visible portion of the top card in a shoe, the device obscures the player's ability to distinguish any meaningful difference in size between the back pattern on the card and the white edge by projecting a disorienting pattern on top of the exposed pattern of the back of the card sitting in card shoe. This pattern could be projected using a digital projector or a simple light source broadcast through a filter designed to alter color and pattern.

There are at least two modes (and a combination of the two modes) that may be practiced in the present technology.

Mode 1: Front-Mounted on Higher Position

A digital projector or LED, halogen lamp, fluorescent light, incandescent light or laser light is mounted above (or below, and/or below) the front surface of the shoe pointed towards the base of the shoe where the card edge is exposed to the player. The digital projector or light source could be either battery powered or powered through an electrical port/cord that runs down the long side of the shoe towards the back and connects to an electricity source in the table. The projector or light would be mounted onto the shoe so that it could be easily removed and replaced.

The digital projector would display an optically confusing light such as a stable or altering (e.g., oscillating, flickering, angularly moving) continuous image or pattern that uses the right combination of geometric shapes, color, or contrast to obscure any identifying marks visible on the exposed card in the shoe. If a light source is used, the light could be beamed through a filter or stencil placed on the front of the light-emitting device. This filter/stencil could serve two purposes: ensure the emitting light (particularly if a laser is used) does not exceed a safe level for human eyes; and also display a pattern, a pattern of bubbles or crossed lines, possibly colored red, blue, or green, which would make identifying the edge difficult.

One benefit of this design is that the light source or digital projector could be easily, quickly, and affordably replaced when necessary, the card edge could be obscured by the disorienting light pattern, and the dealer's actions removing each card from the shoe would not be impeded or in any way altered from the normal procedure.

Mode 2: Lower-mounted underneath the leading edge of the first card.

In this variation, the projector or light source could be mounted at a lower position in front of the slot through which playing cards are withdrawn. The light may be emitted at that position by a flat panel emitter (which would not interfere with playing card withdrawal) or may be reflected at the front of the playing card removal base (or an extension thereof that extends beyond the first forward playing card in the shoe, displayed through the slot). The light source may be then originate from behind and/or underneath the platform in the shoe (and if the delivery shoe is fixed to the table, even from underneath the table through a portal and into) the delivery shoe that holds the deck of cards. An empty space already exists in the currently employed shoe models, behind the back position of the playing cards, and underneath a slide present in the bottom of the delivery shoe to gravitationally assist forward movement of the decks of playing cards. A pattern from the digital projector or the light source could be shone towards the front of the shoe and then reflected up at a backward (towards the rear of the shoe), onto the base of the back of the exposed playing card, using a reflective surface like a mirror or a refractive object such as a prism. The light would be either battery powered or powered through an electrical cord that runs out the back of the shoe.

The light would be beamed through a filter to ensure the intensity of the light was at a safe level for human eyes as well as to broadcast a pattern of lines or some other distinguishing shape or color. The mirror (or light path and prism) would be angled or oriented in such a precise way as to focus or direct the light beams precisely as desired onto the card front. The reflective surface might also be textured to add an additional, disorienting pattern onto the card surface. The benefit of this model is that it takes advantage of empty space that is already part of the traditional shoe. With the exception of the emitted light, the shoe would not look significantly different from the traditional card shoe (the light might also provide an additional, appealing cosmetic benefit to the shoe's appearance).

The dealer shoe may have the front plate as opaque to mask the entire front surface of the forward most playing card while it is within the dealer shoe.

Figure 1B:
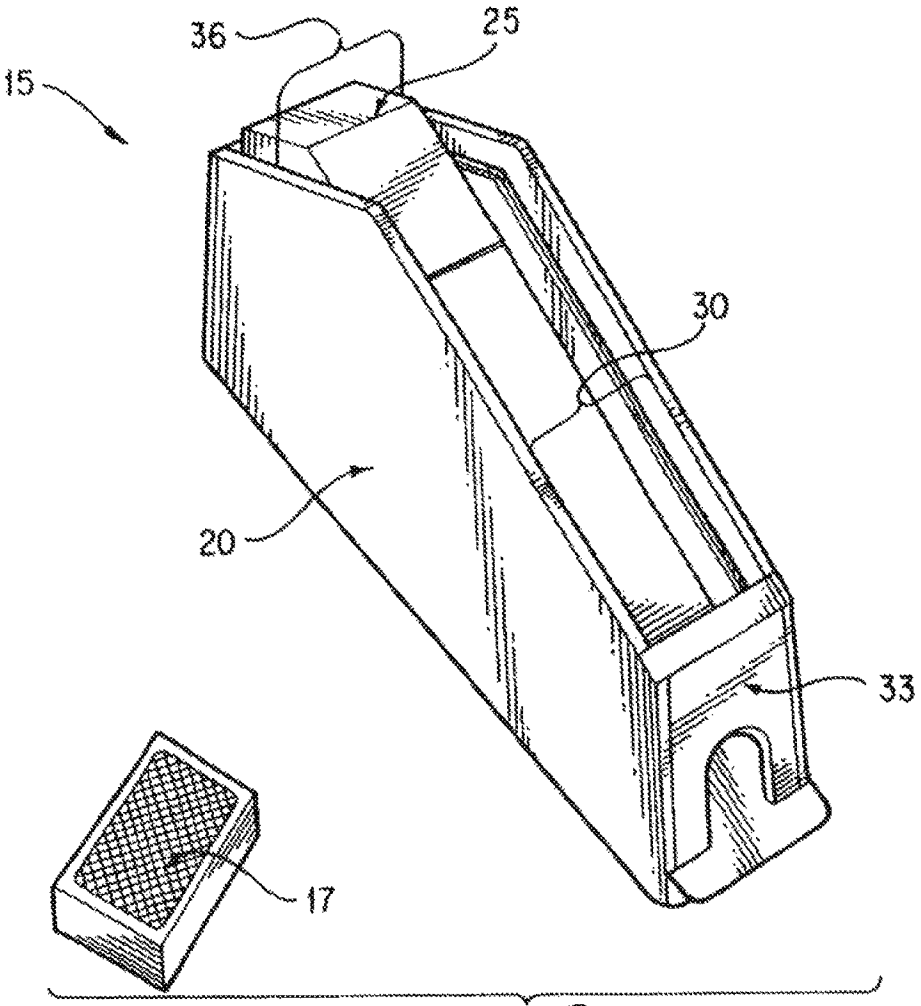

FIGS. 1A and 1B show prior art embodiments (U.S. Pat. No. 6,402,142) of a dealer shoe 15. FIG. 1A shows one embodiment while in use and FIG. 1B shows another embodiment while at rest. Both FIGS. 1A and 1B show two elements of the apparatus: a base 20 and a card roller 25. While in use, the card roller 25 is in the base 20, applying a downward force on the cards 17. As shown in FIG. 1*a*, there is a vacant resting place 36 in the base 20. When not in use, as shown in FIG. 1*b*, the card roller 25 is in the resting place 36, so that the cards 17 may be easily removed, replaced, and/or shuffled.

The base 20 generally sits on a table (not shown), such as a gaming table, and has a card channel 30, a card door 33, and a resting place 36. As shown in FIG. 1*a*, while in use the card channel 30 holds playing cards 17 and the card roller 25. The card door 33 keeps the cards 17 in the card channel 30 and allows the dealer 19 to remove one card 17 at a time. The resting place 36 allows the card roller 25 to rest within the base 20 so that it does not interfere with the replacement of the cards 17. Generally, the playing cards 17 are standard playing cards used in a casino.

Referring to FIGS. 1A and 1B, in the preferred embodiment, the card roller 25 is movably connected to the base 20 and while in use is positioned within the card channel 30 of the base 20. While in use, the card roller 25 applies a downward force on the cards 17 in the card channel 30. The downward force causes the cards 17 to move downward, sliding down the ramp, so that each time an individual card 17 is removed through the card door 33, another card 17 moves into position against the card door 33. While at rest, the card roller 25 is positioned within the resting place 36, as shown by FIG. 1B. The form of the resting place 36 keeps the card roller 25 at rest until the dealer 19 (not shown) moves the card roller 25 out of the resting place 36 and into use.

Once again referring to FIGS. 1A and 1B, generally, the card roller 25 and the base 20 will be made out of the same material so as to simplify manufacturing and to reduce time and cost of manufacturing. Although plastic is preferred, both the base 20 and the card roller 25 can be made from a variety of materials including any type of metal, plastic, wood, rubber, transparent Polymeric materials (e.g., polyethylene, polycarbonate, polyacrylate) or a combination thereof.

FIGS. 1A, 1B, illustrate the method of using the prior art dealer shoe. The method for providing convenient access to and removal of cards 17 starts with the step of inserting or loading one or more decks of cards 17 in the base 20 of the dealer shoe 15, and moving the card roller 25 behind the cards 17.

Figure 2:
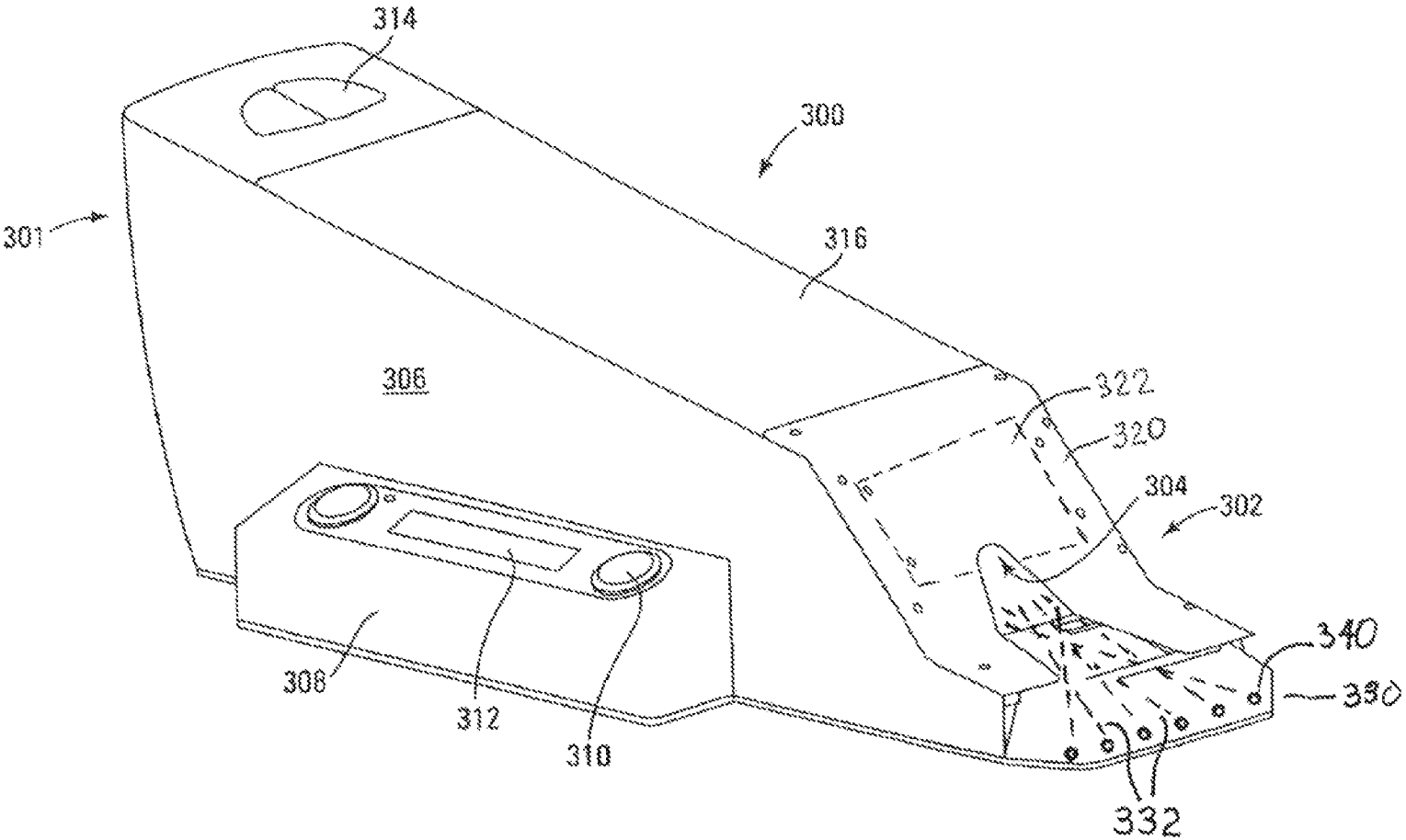
FIG. 2 shows a perspective view of a playing card delivery shoe with a lower positioned set of light emitting elements.

FIG. 2 shows an embodiment of a delivery shoe 300 according to the present technology, with the projected light 332 emitting from the lower forward portion 330 of the shoe 300.

FIG. 2 shows a perspective view of a playing card delivery shoe 300 useful within the scope of the present technology in combination with a lower positioned set of light emitting elements 340 on the forward delivery plate 330. The delivery shoe 300 is shown with its front delivery portion 302, a finger slot 304 for removal of playing cards (not shown), its back 301, side panel 306 and top panel 316 of the delivery shoe 300. A more modern mechanized shoe 300 may be provided with card delivery entry panel cover 314, side information and activation controls 308, with dealer information display 312 and activation button 310. To assist in enablement of one aspect of the present invention, the light emitting elements 340 and the beams of light emission 332 are shown. The emission panel system 340 may be any technologically available source of visible light, especially light within the range of 410-780 nm, and more preferably within the range of 420-720 nm. The emission system 340 should provide enough fluence of visible radiation that the visible radiation will mask the pattern and colors on the back of the forward-most playing card in the delivery shoe behind the front panel 320 and above the emission source 340 and then be reflected off the back surface of that forward-most playing card back to disrupt human optical capability in carefully observing printed patterns and spacing on playing cards which is often present on the backs of printed and cut (converted) playing cards in a gaming environment. These light-emitting systems 340 are part of what is referred to as the light-masking systems of the present technology within casinos. As noted, the light masking system may emit a pattern, a stable light image, a moving/flickering light image, be monochromatic or mixed color light emission system The radiation emitted from the light panel or bulb system 340 reflects off of the back of at least one playing card that has been advanced into the front end 302 of the delivery shoe 300, and may include one, two or preferably more light emitting elements 340 to mask and disrupt visual interpretation of backs of playing cards before they are removed from the delivery shoe 300. Filtered radiation (having passed through template cover (not shown) may be placed over the light-emitting elements (and may be or slid back and forth mechanically so that the transmitted from the light elements 340 further disrupt visual images of the backs of playing card information. Element 322 may be an internal lighting system that can further shine light patterns, especially flickering light patterns down the back side of playing cards and out of the finger slot hole 304.

Figure 3:
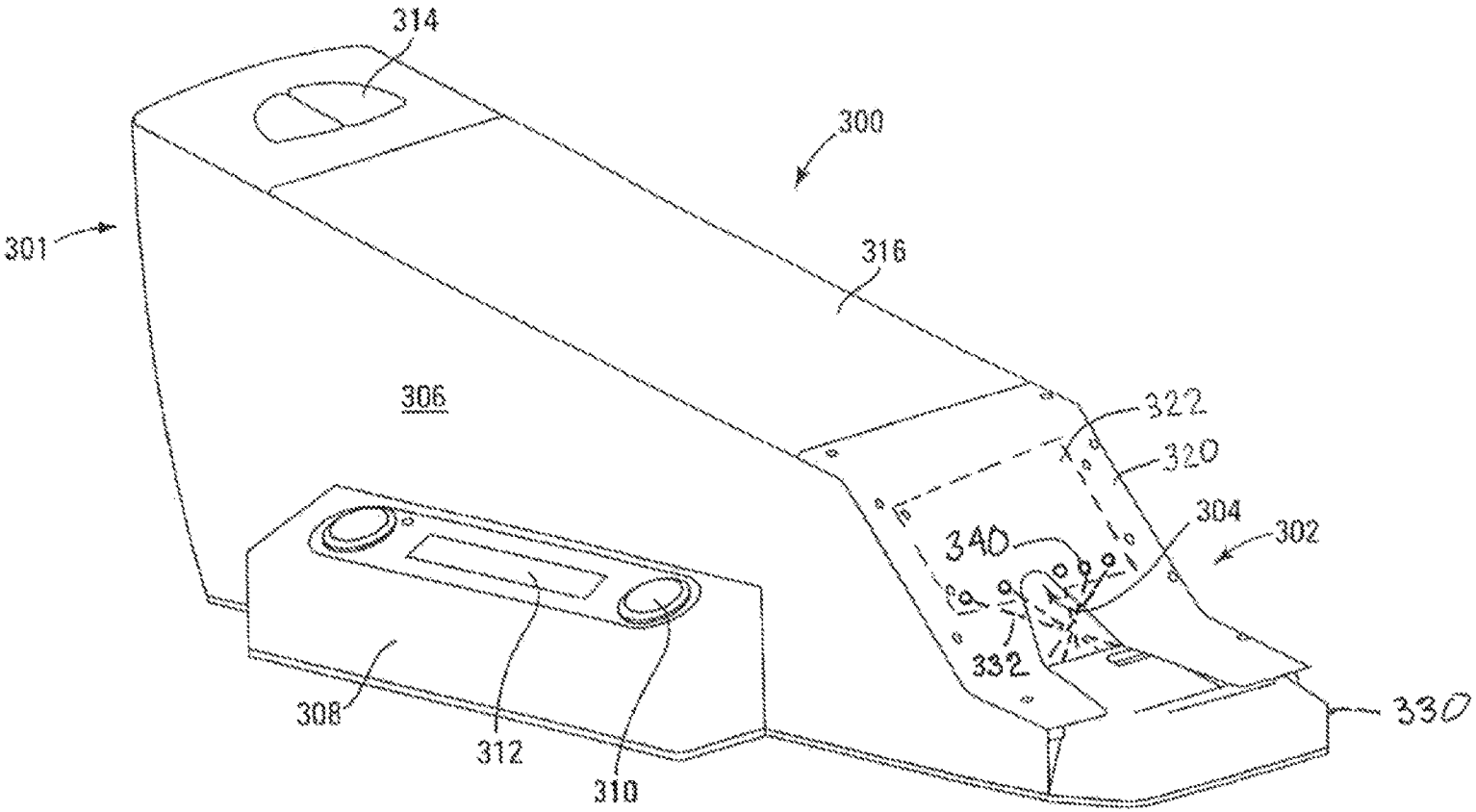
FIG. 3 shows a delivery shoe with the projected light emitting from the lights above the forward most playing card in the shoe.

FIG. 3 shows an embodiment of a delivery shoe 300 according to the present technology, with the projected light 332 emitting from the lights 340 above the forward most playing card 302 in the shoe 300. Same numbers in FIGS. 2 and 3 represent same elements, even though they may be in different physical locations (above or below the finger slot hole 304, for example). As shown in FIG. 3, the light emitting elements 340 are above the finger slot hole 304 and the emitted light 332 is shone downwardly.

There are alternate constructions and designs within the generic scope of the present invention that can embodies within the practice of the appended claims and this application. For example, patterns projected from light elements may be similar in structure to the printed images on card backs, a memory in the shoe may store multiple images for projections to match card backs, advertising may be included in the projections, and the like.

What is claimed:

1. A method for providing access to and removal of playing cards in a dealer shoe after masking patterns and colors on a back of a forward-most playing card in the dealer shoe, comprising the steps of: placing one or more decks of cards in a dealer shoe comprised of a base, front plate forming a lower gap with the plate through which individual playing cards can pass, a top, and opposed sides joining the base, top, two sides and the front plate, the front plate further comprising a light producing element configured to shine light having a visible wavelength over the back of the first playing card extending out of the lower gap; and the visible wavelength and intensity of the shone light reducing optical contrast of different colors and/or shades on the back of the first playing card; shining light having the visible wavelength over the back of the first playing card extending out of the lower gap, thereby masking patterns and colors on a back of a forward-most playing card in the dealer shoe.

2. The method of claim 1 wherein the shone light is in a pattern of the visible wavelengths on the back of the first playing card.

3. The method of claim 2 wherein the shone light is emitted from the top of the shoe over the back of the first playing card extending out of the lower gap.

4. The method of claim 2 wherein the shone light is emitted from the base of the shoe and upwardly over the back of the first playing card extending out of the lower gap.

5. The method of claim 2 wherein the shone light is within +70 nm of a color on the back of the first playing card.

6. The method of claim 3 wherein the wavelength of the shone light is within +70 nm of a color on the back of the first playing card.

7. The method of claim 6 wherein at least two lights are shone over the back of the first playing card extending out of the lower gap, and the at least two lights differ by at least +50 nm of each other.

8. The method of claim 4 wherein the wavelength of the shone light is within +70 nm of a color on the back of the first playing card.

9. The method of claim 5 wherein at least two lights are shone over the back of the first playing card extending out of the lower gap, and the at least two lights differ by at least +50 nm of each other.

10. The method of claim 1 wherein the shone light is emitted with a visual distraction factor selected from the group consisting of fluttering light intensity, angular light movement across the back of the first playing card extending out of the lower gap, patterns of shone light, and variation over time in light wavelengths.

11. The method of claim 1 further comprising placing a set of randomized playing cards in the dealer shoe so that one surface of a forward most playing card faces the shone light.

12. A dealer shoe configured to provide access to and removal of playing cards from within the dealer shoe comprising:

a base, a front plate forming a lower gap with the plate through which individual playing cards can pass, a top, and opposed sides joining the base, top, two sides and the front plate to form a card-carrying cavity, the front plate further comprising a visible-light producing element configured to shine light having a visible wavelength over a back of a first playing card extending out of the lower gap; and the visible wavelength and intensity of the shone light capable of reducing optical contrast of different colors and/or shades on the back of the first playing card.

13. The dealer shoe of claim 12 wherein the shone light is provided as a pattern of visible light on the back of the first playing card.

14. The dealer shoe of claim 13 wherein the shone light is emitted from a light source at the top of the shoe over the back of the first playing card extending out of the lower gap.

15. The dealer shoe of claim 13 wherein the shone light is emitted from a light source at the base of the shoe and upwardly over the back of the first playing card extending out of the lower gap.

16. The dealer shoe of claim 13 wherein the wavelength of the shone light is within ±70 nm of a color on the back of the first playing card.

17. The dealer shoe of claim 13 wherein at least two lights are shone over the back of the first playing card extending out of the lower gap, and the at least two lights differ by at least ±50 nm of each other and at least one light is shone as a pattern.

18. The dealer shoe of claim 14 wherein the wavelength of the shone light is within ±70 nm of a color on the back of the first playing card.

19. The dealer shoe of claim 12 wherein the shone light is within ±70 nm of a color on the back of the first playing card.

20. The dealer shoe of claim 19 wherein at least two lights are shone over the back of the first playing card extending out of the lower gap, and the at least two lights differ by at least ±50 nm of each other.

21. The dealer shoe of claim 12 wherein the shone light is emitted with a visual distraction factor selected from the group consisting of fluttering light intensity, angular light movement across the back of the first playing card extending out of the lower gap, and variation in light wavelengths.

22. The dealer shoe of claim 12 further comprising placing a set of randomized playing cards in the dealer shoe so that one surface of a forward most playing card faces the shone light.

* * * * *